US008157667B2

(12) United States Patent
Tome et al.

(10) Patent No.: US 8,157,667 B2
(45) Date of Patent: Apr. 17, 2012

(54) GOLF SWING TRAINING AID

(76) Inventors: Robert Tome, Encino, CA (US); Thomas Ciccolella, Burbank, CA (US)

( * ) Notice: Subject to any disclaimer, the term of this patent is extended or adjusted under 35 U.S.C. 154(b) by 0 days.

(21) Appl. No.: 12/883,675

(22) Filed: Sep. 16, 2010

(65) Prior Publication Data

US 2011/0070965 A1 Mar. 24, 2011

Related U.S. Application Data

(60) Provisional application No. 61/244,567, filed on Sep. 22, 2009.

(51) Int. Cl.
*A63B 69/36* (2006.01)

(52) U.S. Cl. ..... 473/278; 473/139; 473/150

(58) Field of Classification Search ..... 473/150, 473/157, 159, 168, 218, 262, 278, 279, 386, 473/409, 139; D21/791, 792
See application file for complete search history.

(56) References Cited

U.S. PATENT DOCUMENTS

| | | | | |
|---|---|---|---|---|
| 3,348,847 | A * | 10/1967 | Fischl | 473/262 |
| 3,423,096 | A | 1/1969 | Tone | |
| 4,130,283 | A * | 12/1978 | Lindquist | 473/262 |
| 4,875,685 | A | 10/1989 | Ballinger et al. | |
| 5,356,147 | A | 10/1994 | MacDonald | |
| 5,662,531 | A | 9/1997 | Durso | |
| 5,830,080 | A | 11/1998 | Reynolds | |
| 6,554,716 | B1 | 4/2003 | Loh et al. | |
| 6,569,026 | B1 * | 5/2003 | Weis | 473/139 |
| 6,902,494 | B1 | 6/2005 | Frishberg | |
| 7,549,932 | B1 | 6/2009 | Miyamoto | |
| 7,568,980 | B1 | 8/2009 | Janus et al. | |
| 2007/0167259 | A1 * | 7/2007 | Lipidarov | 473/387 |
| 2007/0191128 | A1 * | 8/2007 | Tirol | 473/150 |
| 2007/0298896 | A1 | 12/2007 | Nusbaum et al. | |
| 2008/0032811 | A1 | 2/2008 | Bearden | |

* cited by examiner

*Primary Examiner* — Nini Legesse
(74) *Attorney, Agent, or Firm* — Kelly & Kelley, LLP

(57) ABSTRACT

The golf swing training aid for simulating the feeling of creating a divot during a practice golf swing includes a flexible mat including an upper surface and a leading edge. A flexible ball support member is spaced from the leading edge for temporarily supporting a golf ball therebetween. The support member resiliently flexes away from the leading edge as the golf ball is struck by a golf club permitting the golf club to travel below the upper surface immediately beyond the leading edge and provide a divot feedback to a golfer. The upper surface or the ball support member comprises resiliently flexible plastic and can also include a ball alignment feature. The flexible mat includes an upper pad overlying a turf layer disposed above a resiliently flexible base layer. The flexible mat comprises a U-shaped recess where the ball support member is disposed within.

16 Claims, 5 Drawing Sheets

GOLF SWING TRAINING AID

FIELD OF THE INVENTION

The present invention generally relates to a golf swing training aid. More particularly, the present invention relates to a golf swing training aid designed to provide sensory feedback to a golfer when practicing an iron shot. The sensory feedback provides the visual and physical feel of creating a "proper" divot.

BACKGROUND OF THE INVENTION

Golf is a precision club-and-ball sport where competitors, i.e. golfers, use many types of clubs in an attempt to hit a golf ball into a hole on a golf course while employing the fewest number of strokes. The game of golf does not require a standardized playing area. Golf courses are instead typically uniquely designed and may vary in size, shape, structure, length, type and/or quantity of obstacles (e.g. sand traps or water hazards), etc. Golfers must, therefore, know how to make various shots with different clubs, depending upon the location and distance the golfer is from the hole. Knowing which club to use is generally a function of the golfer learning how far the club can hit the golf ball. Additionally, obstacles such as trees or sand traps may prohibit the golfer from hitting a ball in a certain direction, at a certain trajectory, or with a certain club.

Golfers generally use a "driver" to hit a golf ball long distances off the tee, depending, of course, on the initial distance the golfer is from the hole. Drivers have the largest head and typically are the longest in length. Fairway woods have a somewhat smaller head and are relatively shorter in length and are designed for long-distance shots such as from the tee or from the fairway. The next class of clubs includes the so-called "irons". Irons are the most numerous and versatile class of golf clubs. These clubs are typically relatively shorter in length than the driver or the woods and have a generally increasing angled club head as per the club number. The iron club head has a leading edge that is somewhat sharply rounded. This edge may dig up a chunk of turf from the ground during a shot—commonly called a "divot". Golfers oftentimes create divots in the fairway because the golf ball is struck on the down swing such that the club digs into the ground on the follow through after striking the ball. Lastly, putters are designed to hit the ball along the fringe or the surface of the green to roll the ball into the cup.

There are many golf ball swing trainer-type devices available in the prior art that endeavor to improve the characteristics of a golf swing. Some devices are directed to the design of compact swing training aids that enable a golfer to practice golf swings, such as putting, in relatively confined areas of the home or office. For example, some training aids include a cup surrounded by a carpeted or synthetic-type material designed to simulate low-cut grass on a putting green. These devices are typically smaller in size and allow the golfer to practice putting inside of a building. Other golf ball swing training aids enable a golfer to practice a golf swing while away from the golf course or a driving range. Such activities may take place in a yard or in a nearby park having a relatively confined area. In these environments, golfers may practice hitting lightweight, perforated plastic balls that travel only a few feet and have little force upon impact despite being struck solidly with the golf club. Others may use nets to confine the distance the golf ball may travel after being struck. Such golf swing training aids allow golfers to practice golf swing skills by simulating game-type and/or turf-type conditions. But, there are relatively few such training aids that enable the golfer to specifically work on practicing iron shots.

One particular problem with mastering hitting a golf ball with an iron is that the iron shot is not easy to practice. As briefly described above, hitting a golf ball with an iron can be tricky to master because it is intuitively contrary to instinct. That is, when a golfer hits a shot with an iron, the club head should strike the golf ball first, then dig into the ground as the club head travels downwardly along its trajectory. Hitting the golf ball squarely in this manner provides the best possible stroke for maintaining distance and control. The iron club head should come down and compress the golf ball between the ground and the club face. This produces back spin on the golf ball that, when combined with the angled club head, causes the golf ball to rise. Thereafter, the club slices into the ground and picks up a wedge of dirt and grass. This is the so-called "divot". Divots can be particularly destructive to the golf course and may require attention from the grounds crew to ensure the grass continues to grow in and around the divot. It also helps when the golfer replaces the divot upon removal from the ground at the time of the shot. The very nature of the iron shot certainly rules out practice in the house and, for most people, rules out the possibility of practicing in a backyard since continued practice in one spot would tend to ruin the lawn.

Some devices known in the art consist of practice boards or platforms designed to allow the golfer to practice driving shots, such as those with irons, without damaging natural grass. But none of these devices are particularly adapted to permit the golfer to practice a true fairway iron shot wherein the club head is able to continue traveling downwardly into the ground after striking the ball. For example, some golf practice mats known in the art are made from artificial turf. The turf mats are designed so a golfer can get the feel of hitting a golf ball off a grass surface without actually needing a natural grass patch. This enables the golfer to practice without damaging natural grass. But, this type of mat is better suited for practicing shots with drivers, woods or putters because there is no "give" in the relatively rigid structure that supports the artificial grass. As with an iron shot, it is desirable that the golfer strike the golf ball such that the club head continues to descend into the ground. An abrupt stoppage of the club against a solid unforgiving surface can cause injury to the forward shoulder, elbow or wrists, especially with repetitious use and practice. Most undesirable is the fact that the golfer assuredly cannot hit under and through the ball because the club bounces off the mat upon impact. Hence, the golfer is unable to practice the iron shot while simultaneously getting the feel and resistance of creating a divot that the golfer otherwise experiences when hitting an iron shot from a natural grass turf.

In an effort to rectify the problems discussed above with respect to the practice boards or platforms, U.S. Pat. No. 3,348,847 to Fischl discloses a golf practice device having an artificial divot means disposed in a platform. The divot means is removably embedded in a concave portion formed into the surface of the base of the platform. The inwardly concave recess generally mates with the divot means such that, when in the concave portion, the divot means is generally in the same plane as the rest of the platform. In use, the golfer first strikes the golf ball. Then, the divot means is struck by the golf club head as it travels toward the nadir of its trajectory—the nadir being disposed beneath the plane of the platform. In turn, the golf club head strikes and launches the divot means out from within the concave recess in the platform. Thus, the Fischl practice device improves upon the aforementioned prior art such that a golfer may better experience creating a divot in a natural turf. But, such a loosely placed divot means in a concave portion of a platform does not provide accurate and consistent physical resistance. Thus, Fischl is unable to provide the type of resistance one would expect from cutting through dirt and grass to create a divot in natural grass turf.

Moreover, U.S. Pat. No. 6,746,340 to Dover similarly discloses an artificial turf golf practice mat that has a removable rectangular divot patch sized to simulate a real dirt divot on a fairway. The forward end of the divot patch is anchored to a rubber base such as by a hook and loop, a clamp or through permanent attachment to the artificial grass layer. In action, the divot patch is propelled away from the mat in a similar manner as described above with respect to the Fischl patent. When struck, the rear edge of the divot patch disjoins from the top layer of the platform and is propelled forward by the club head. Thereafter, the golfer may re-insert the divot patch back into a portion of the platform to practice another shot. Like Fischl, Dover fails to adequately account for the type of resistance that a golfer may experience when properly striking a golf ball with an iron. That is, the aforementioned divot patch is only lightly anchored to the golf swing training aid and is, therefore, incapable of adjustably simulating such resistance as would be experienced with natural turf. Moreover, Fischl and Dover both fail to provide a swing training aid that does not have components that disjoin or are ejected from the trainer itself. Fischl and Dover also do not disclose any means for providing viable visual feedback.

Accordingly, there is a need for a golf swing training aid capable of enabling a golfer to repetitiously and safely practice hitting an iron shot. Such a golf swing training aid should provide visual feedback in the form of a target plane where the golfer should strike the golf ball on the field surface, should enable the club head to first strike the golf ball and then continue downwardly along its trajectory, and should provide sensory feedback in the form of resistance that simulates the type of resistance a golfer can expect to experience when digging a divot in a natural grass surface. The present invention fulfills these needs and provides further related advantages.

SUMMARY OF THE INVENTION

The golf swing training aid for simulating the feeling of creating a divot during a practice golf swing includes a flexible mat including an upper surface and a leading edge. The flexible mat has a defined thickness. A flexible ball support member is spaced from the leading edge for supporting a golf ball adjacent to the leading edge. A golf ball is temporarily supported between the leading edge and support member. The support member resiliently flexes away from the leading edge as the golf ball is struck by a golf club permitting the golf club to travel below the upper surface immediately beyond the leading edge and provide a divot feedback to a golfer.

The upper surface comprises resiliently flexible plastic and can also include a ball alignment feature. The ball alignment feature can be formed in a multitude of ways. In one embodiment the ball alignment feature includes a pair of protrusions on the upper surface thereby capturing the golf ball along a channel. In another embodiment the ball alignment feature is a scalloped cut along the leading edge thereby capturing the golf ball along the scalloped cut. In yet another embodiment the ball alignment feature is an open-ended slot disposed along the leading edge thereby capturing the golf ball along the slot.

The flexible mat includes an upper pad overlying a turf layer disposed below the upper surface. The flexible mat also can include a resiliently flexible/rubber-like base layer disposed below the turf layer. The turf layer may be Astroturf or any other suitable turf material. The flexible mat comprises a U-shaped recess and the ball support member can be disposed within the U-shape recess. The ball support member can also comprise a resiliently flexible plastic. In an embodiment, the ball support member is a cantilevered angled surface forming an obtuse angle relative to a top side of the upper surface. In an embodiment, the upper surface or the ball support member can be removably attached relative to the mat. This allows different structures to be utilized for providing different tactile feedback for different golfers.

The golf swing training aid provides visual feedback by identifying desired contact areas of the golf club head with the upper surface and the turf layer. The golf swing training aid also provides physical feedback in the form of resistance at the upper surface and ball support member. For example, the golf swing training aid enables a golfer to practice a preferred iron golf club swing that results in proper contact of the club head with the golf ball along a trajectory that provides desired physical resistance comparable to creating a "proper" divot in natural grass.

Initially, a golfer swings an iron golf club along a trajectory toward a golf ball resting between the upper surface and ball support member. The golfer visually identifies the plane where the golf ball rests via the upper surface. The golfer visually identifies the desired angle of the club head relative to the upper surface, turf, and ball support member. The golfer receives initial physical feedback from contact of the club head with either the upper surface, the turf, or the ball support member. After contacting the golf ball, the trajectory of the golf club continues downwardly beyond and below the upper section. Here, the ball support member preferably exerts resistance on the golf club head comparable to creating a divot in natural grass turf. The ball support member bends and allows passage of the club head therethrough. The rubber mat below the turf layer provides the golfer with a visual target plane of the approximate nadir of the trajectory of the golf swing. The rubber mat also provides physical sensory feedback in the event the club head trajectory is too deep (abrupt contact therewith) or too shallow (no contact therewith).

Other features and advantages of the present invention will become apparent from the following more detailed description, when taken in conjunction with the accompanying drawings, which illustrate, by way of example, the principles of the invention.

BRIEF DESCRIPTION OF THE DRAWINGS

The accompanying drawings illustrate the invention. In such drawings.

DETAILED DESCRIPTION OF THE PREFERRED EMBODIMENTS

Figure 1:
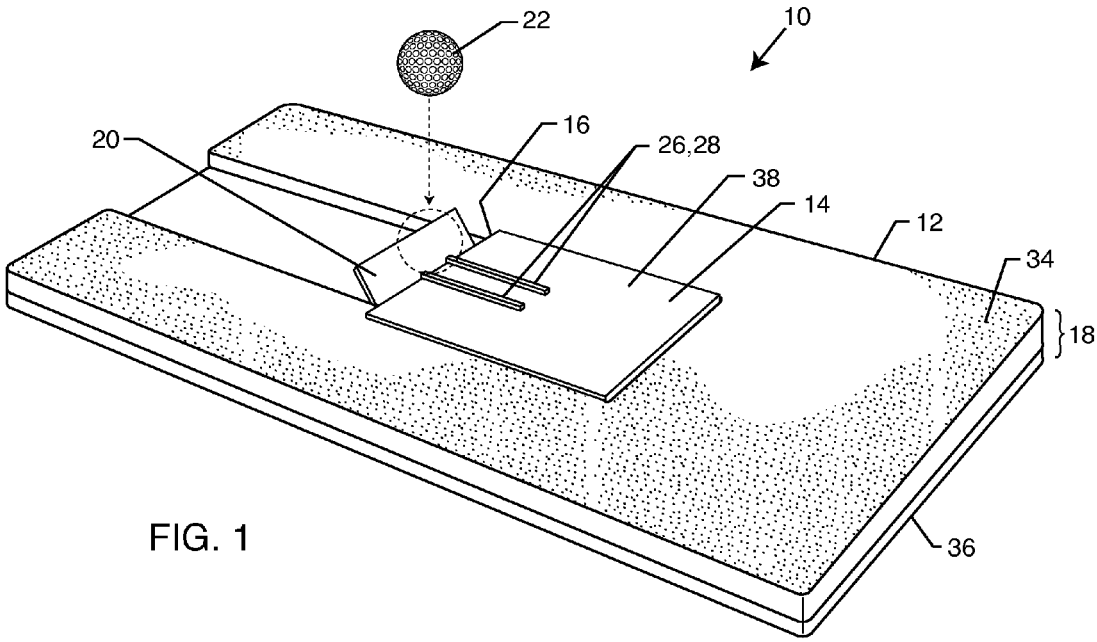
FIG. 1 is a perspective view of an exemplary golf swing training aid embodying the present invention.
Figure 2:
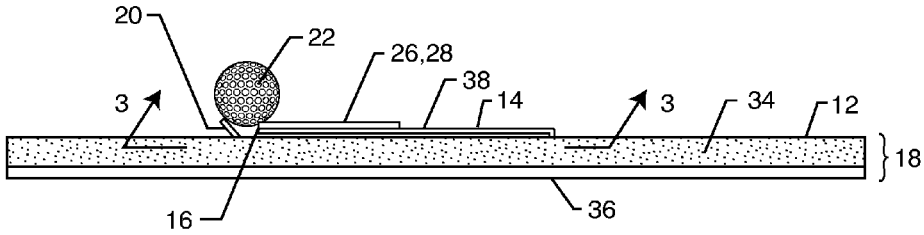
FIG. 2 is a side view of the structure of FIG. 1.
Figure 3:
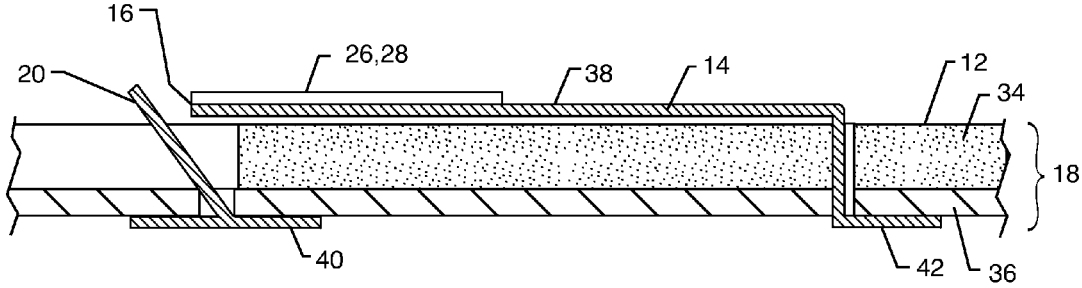
FIG. 3 is an enlarged sectional side view of the structure of FIG. 1 taken along lone 3-3.

As shown in the drawings for purposes of illustration, the present invention for a golf swing training aid is referred to generally by the reference number 10. FIG. 1 is a perspective view of an exemplary golf swing training aid 10 embodying the present invention. FIG. 2 is a side view of the structure of FIG. 1, and FIG. 3 is an enlarged sectional side view of the structure of FIG. 1 taken along lone 3-3. The golf swing training aid 10 simulates the feeling of creating a divot during a golf swing and includes a flexible mat 12 including an upper surface 14 and a leading edge 16. The flexible mat 12 has a defined thickness 18. A flexible ball support member 20 is spaced from the leading edge 16 for supporting a golf ball 22 therebetween. A golf ball 22 is temporarily supported between the leading edge 16 and support member 20. The golf ball 22 is then struck by a golf club 24 which resiliently flexes the leading edge 16 and support member 20 providing tactile feedback to a golfer.

Figure 4:
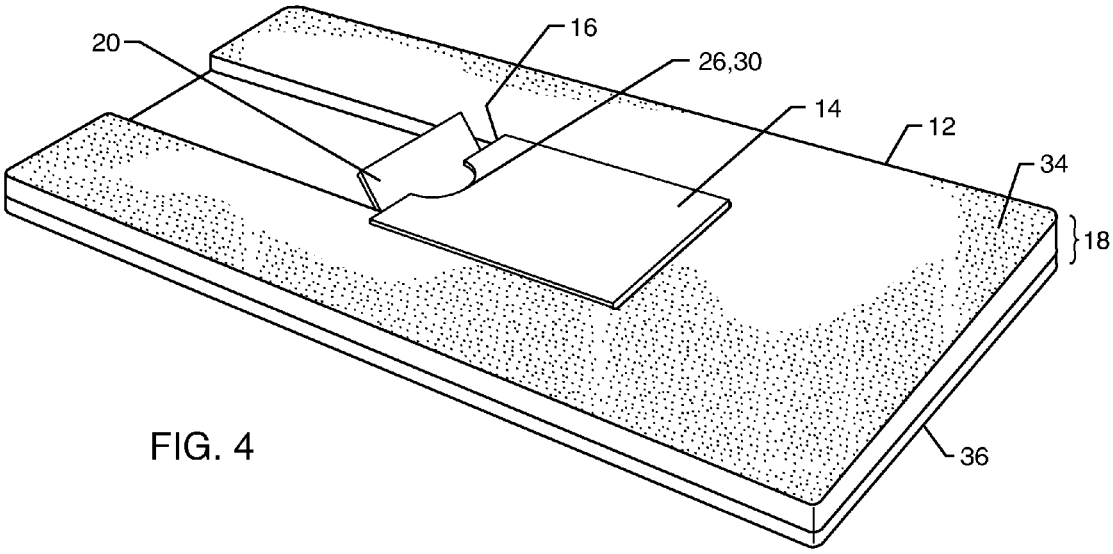
FIG. 4 is a view similar to FIG. 1, now with a new embodiment of a ball alignment feature.
Figure 5:
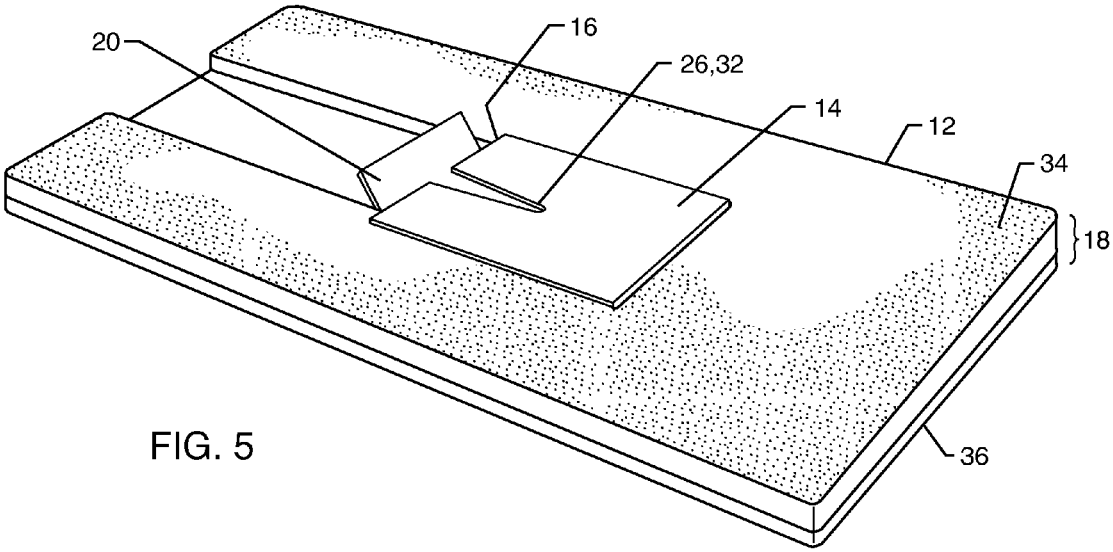
FIG. 5 is a view similar to FIG. 1, now with a new embodiment of a ball alignment feature.

The upper surface 14 comprises resiliently flexible plastic, however many materials may be used. The upper surface 14 can also include a ball alignment feature 26. The ball alignment feature 26 can be formed in a multitude of ways. In one embodiment the ball alignment feature 26 includes a pair of protrusions 28 on the upper surface 14 thereby capturing the golf ball along a channel. FIG. 4 is another embodiment of the ball alignment feature 26 where now a scalloped cut 28 is formed along the leading edge 16. A golf ball can then be placed along the scalloped cut 30 and against the ball support member 20. FIG. 5 shows yet another embodiment the ball alignment feature 26 not formed as an open-ended slot 32 disposed along the leading edge 16. A golf ball can then be placed along the slot 32 and against the ball support member. In yet other embodiments, the protrusions 28, cut 30, or slot 32 could be integrated and formed upon the ball support member 20 instead of the upper surface 14. It can be seen that there are a multitude of ways to capture the golf ball between the leading edge 16 and the ball support member 20, as this disclosure is not intended to limit it to the precise forms described herein.

The flexible mat 12 includes a turf layer 34 disposed below the upper surface 14. The flexible mat 12 can include a rubber base layer 36 disposed below the turf layer 34. The turf layer 34 may be Astroturf or any other suitable turf material. The turf layer 34 is U-shaped and the ball support member 20 can be disposed within the U-shape. The rubber base layer 36 provides grip such that the mat 12 doesn't move once placed upon the ground. Providing a non-slip mat 12 is critical as a golfer may be standing upon the mat 12 when practicing a swing. Alternatively, a golfer would be standing next to the mat 12 during a swing and it is desired to have the mat 12 remain in place even when a golf club strikes the leading edge 16 and the ball support member 20.

Both the upper support 14 and the ball support member 20 can be made of a resiliently flexible plastic. As shown in FIG. 3, the ball support member 20 is a cantilevered angled surface forming an obtuse angle relative to a top side of an upper pad 38. The ball support member 20 can include a base portion 40 which rests below the rubber layer 36. The base portion 40 is captured below the mat 12 and held in place due to the weight of the mat 12 above. Similarly, the upper support 14 can include a base portion 42 which rests below the rubber layer 36. The base portion 42 is captured below the mat 12 and held in place due to the weight of the mat 12 above.

Figure 6:
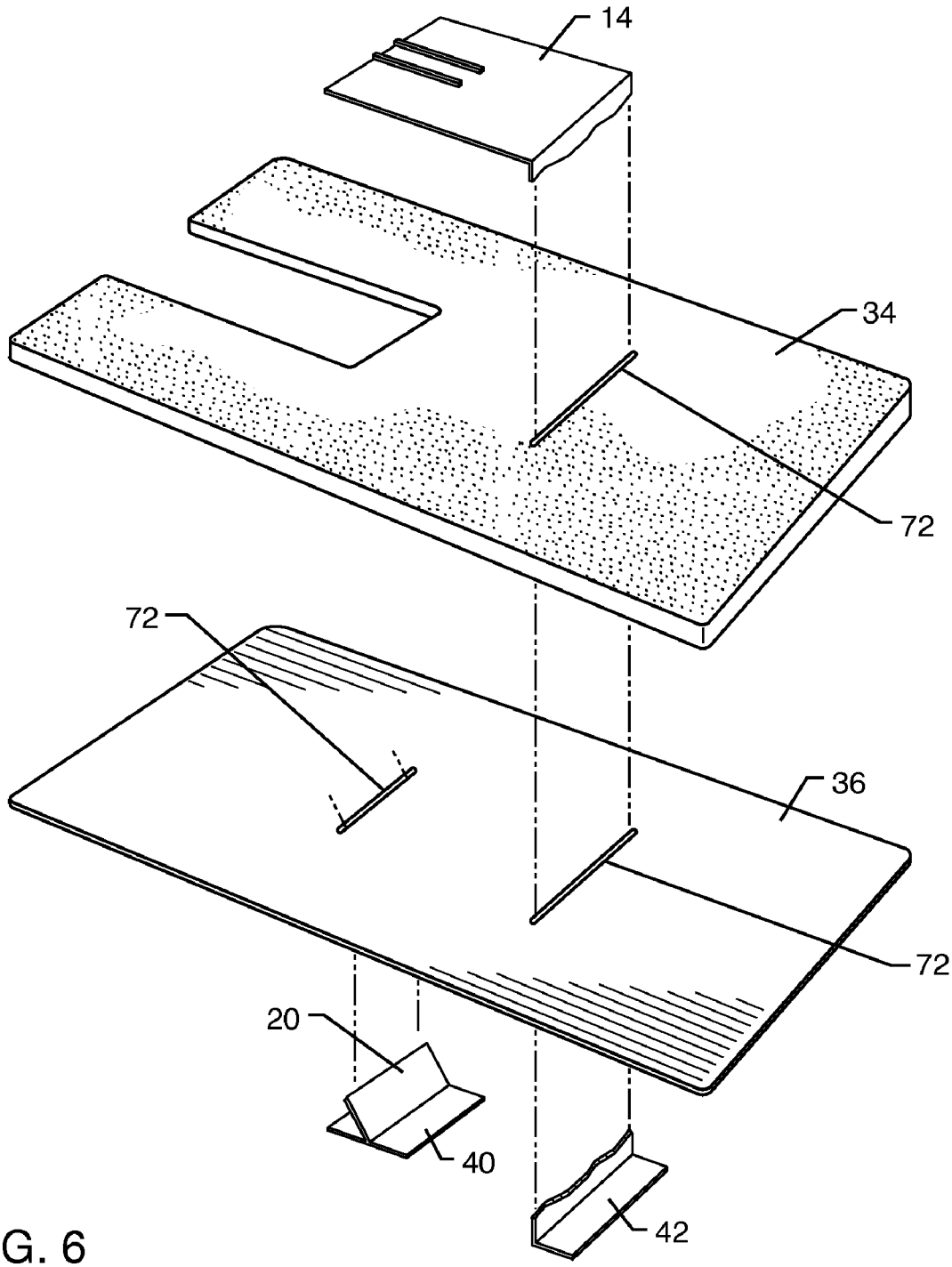
FIG. 6 is an exploded perspective view of the structure of FIG. 1.

FIG. 6 is an exploded perspective view of the structure of FIG. 1. FIG. 6 shows how the upper surface 14 or the ball support member 20 can be removably attached relative to the mat 12. This allows different structures to be utilized for providing different tactile feedback for different golfers. The rubber layer 36 also provides protection to the surface or ground it is resting upon. Such a surface might be inside a business office or a person's residence. Damage from a golf club striking hardwood floors or carpet can leave permanent damage. Also, the rubber layer 36 can provide feedback to the golfer when a swing is too low. Such an impact with the rubber layer 36 will feel substantially different as compared to only striking the leading edge 16 and the ball support member 20.

FIGS. 7-10 show a sectional side view of a golf ball 22 being struck by a golf club 24. The dashed line shows the trajectory of the golf club 22 as it follows through the leading edge 16 and ball support member 20. It is the thickness 18 of the mat 12 that allows the golf club 22 to swing below the upper surface 14.

The golf swing training aid 10 assists golfers in developing an effective golf swing by teaching the dynamics of interfacing the golf ball 22 with a golf club 24. The golf swing training aid 10 provides visual feedback by identifying desired contact areas of the golf club 22 with the upper surface 14, turf layer 34, and the golf ball 22. The golf swing training aid 10 also provides physical feedback in the form of resistance at the upper surface 14 and ball support member 20. For example, the golf swing training aid 10 enables a golfer to practice a preferred iron golf club swing that results in proper contact of the club head with the golf ball 22 along a trajectory that provides desired physical resistance comparable to creating a "proper" divot in natural grass.

Initially, a golfer swings an iron golf club 24 along a trajectory toward a golf ball 22 resting between the upper surface 14 and ball support member 20. The golfer visually identifies the plane where the golf ball 22 rests via the upper surface 14. The golfer visually identifies the desired angle of the club head 24 relative to the upper surface 14, turf 34, and ball support member 20. The golfer receives initial physical feedback from contact of the golf club head 24 with either the upper surface 14, the turf 34, or the ball support member 20. After contacting the golf ball 22, the trajectory of the golf club 24 continues downwardly beyond and below the upper section 14. Here, the ball support member 20 preferably exerts resistance on the golf club head 24 comparable to creating a divot in natural grass turf. The ball support member 20 bends and allows passage of the golf club head 24 therethrough. The rubber mat 36 below the turf layer 34 provides the golfer with a visual target plane of the approximate nadir of the trajectory of the golf swing. The rubber mat 36 also provides physical sensory feedback in the event the golf club head 24 trajectory is too deep (abrupt contact therewith) or too shallow (no contact therewith).

Figure 11:
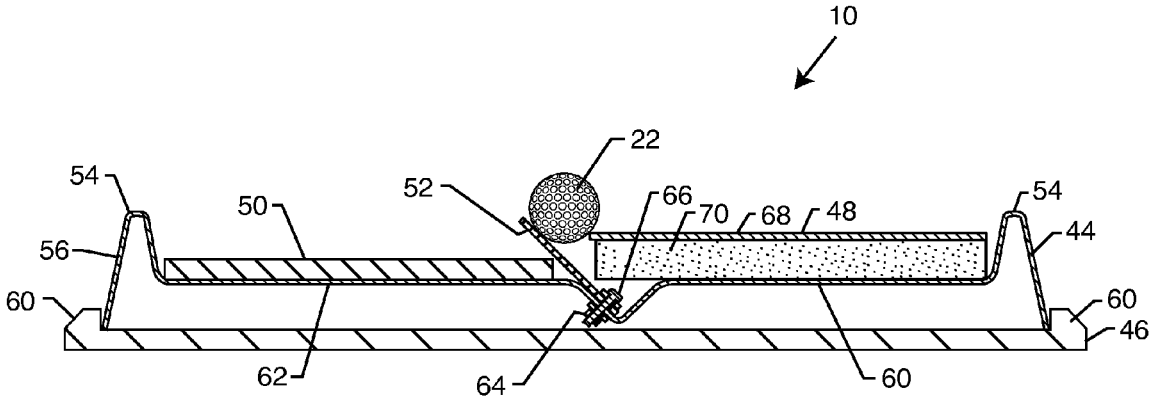
FIG. 11 is another embodiment of an exemplary golf swing training aid embodying the present invention.

FIG. 11 is another embodiment of an exemplary golf swing training aid 10 embodying the present invention previously disclosed in provisional application 61/244,567 filed on Sep. 22, 2009, the contents of which are fully incorporated herein. In this embodiment, the golf swing training aid 10 generally includes a base 44 supported by a mat 46. The mat 46 is preferably made from rubber and provides stability for the base 44 such that the golf swing training aid 10 does not move when a golfer practices a golf swing in accordance with the embodiments disclosed herein. The base 44 of the golf swing training aid 10 includes an upper surface 48, a lower surface 50, and an intermediate surface 52 disposed therebetween. The plane of the intermediate surface 52 extends up at an angle and out from the horizontal plane of the upper surface 48 so a golf ball 22 can be positioned. The positioning of the lower surface 50, as described in more detail below, enables the golfer to continue the downward trajectory of the golf club after striking the golf ball 22. The intermediate surface 52 preferably provides sensory feedback to the golfer as one would experience when creating a divot in a natural grass turf during an iron shot. The placement of the upper surface 48 relative to the lower surface 50, in combination with the intermediate surface 52 therebetween, provides a system for a golfer that encourages the ideal swing trajectory by providing visual and sensory feedback to the golfer.

The base 44 generally forms an area wherein the golfer may practice an iron shot. Specifically, the base 44 includes a raised outer perimeter 54 encompassing the exterior of both the upper surface 48 and the lower surface 50. The base 44 further includes downwardly extending perimeter walls 56 angled outwardly away from the raised perimeter 54 to provide support, in conjunction with the mat 46, for the golf swing training aid 10. The perimeter wall 56 on each side of the base 44, extends down into a corner perimeter 56 formed between perpendicular sections of the mat 46. An end stop 60, formed as part of the mat 46, is further disposed around the exterior of the perimeter wall 56 to prevent movement of the base 44 during use of the golf swing training aid 10. The base of the mat 46 may further include a non-slip surface to mitigate any potential movement thereof during use.

Extending inwardly from the raised perimeter 54 is an upper support 60 and a lower support 62. The supports 60, 62 extend generally horizontally across the plane of the mat 46 and provide support for the upper surface 48 and the lower surface 50. The base 44 further includes a fastener section 64 disposed between the upper support 60 and the lower support 62. In one embodiment, the upper support 60, the lower support 62 and the fastener section 64 are manufactured out of one piece of material, wherein the fastener section 64 is defined by the portion of the base 44 that departs from the plane of the supports 60, 62. Alternatively, the fastener section 64 may join separate upper and lower supports 60, 62 with a fastener 66 in the fastener section 64. In this embodiment, the fastener 66 may enable the intermediate surface 52 to be interchangeable with the base 44.

The upper surface 46 rests on the upper support 60. The upper surface 48 generally includes an upper layer 68 and a lower layer 70. Preferably, the upper layer 68 is made from a synthetic material designed to replicate natural grass. This provides the golfer with the look and feel of striking the golf ball 22 from a natural grass surface. The lower layer 70 should be made from a compressible foam or cushion material that allows the head of the golf club 24 to compress the lower layer 70 during contact. Providing a compressible material in the form of the lower layer 70 better simulates the type of impact that the club head may experience upon contact with the natural grass surface and the underlying dirt layer after hitting the golf ball 22.

The layers 68, 70 of the upper surface 48 may be permanently attached to or otherwise selectively removably attached to the upper support 60. The lower layer 70 may attach to the upper support 60 by any method known in the art, e.g. by an adhesive or a mechanical mechanism, such that the upper surface 48 does not move or shift upon contact from the golf club 24. Such attachment preferably maintains the upper surface 48 in a fixed position. Similarly, it is desirable that the lower surface 50 be either permanently attached to or otherwise selectively removably attached to the lower support 62. It is particularly preferred that the lower surface 50 remain stationary upon any direct contact from the head of the golf club 24. The head of the golf club 24 preferably does not directly contact the lower surface 50. Rather, the golfer using the golf swing training aid 10 should, at most, skim the top of the lower surface 50. In terms of training, it is expected that a golfer, inexperienced golfers especially, may inadvertently contact the lower surface 50. Therefore, the lower surface 50 should at least be secured to the lower support 62 to prevent movement thereof in the event of accidental direct contact from the head of the golf club 24.

In a particularly preferred embodiment, the upper surface 48 and the lower surface 50 selectively removably attach to the upper support 60 and the lower support 62, respectively. In this embodiment, the golfer may vary the height of the respective surfaces 48, 50, depending on the desired look and feel of the iron shot desired to practice. In this regard, the golf swing training aid 10 may simulate different types of iron shots. A golfer may practice fairway, rough or deep rough shots by varying the type of material and thickness of the upper and lower surfaces 48, 50. The upper layer 68 of the upper surface 16 simulates the top layer of grass and may be of short length, medium length or long length synthetic grass to simulate fairway, rough or deep rough natural grass, respectively. For example, the golf ball 22 may sit higher in coarser/shorter synthetic grass designed to replicate fairway grass. The head of the golf club 24 will need to pass through hardly any synthetic grass to contact the golf ball 22. Alternatively, the golf ball 22 may sit deep within less dense and longer synthetic grass designed to replicate deep rough cut grass. In this embodiment, the golfer must swing through relatively more synthetic grass to initiate contact with the golf ball 22. The longer synthetic grass exerts some initial resistance on the head of the golf club 24 not otherwise felt by the golfer when the upper layer 68 simulates fairway grass. Hence, it is desirable that the upper surface 48 be changeable so the golfer can practice iron shots based on different types and depths of grasses. The golf swing training aid 10 provide sensory feedback through various degrees of resistance when the golfer swings through different types and depths of grasses and also enables the golfer to visually identify the ideal contact location with the golf ball 22 depending how deep the golf ball 22 sits in the grass.

Moreover, the fastener 66 may be selectively removable from engagement with the upper support 60, the lower support 62 and/or the fastener section 64. In one embodiment, removal of the fastener section 64 enables a golfer to selectively disengage and/or replace the intermediate surface 52 with one of a plurality of other intermediate surfaces that may be used with the golf swing training aid 10. In this regard, the intermediate surface 52 may vary in length, height, width or other material characteristics such as stiffness that change the sensory feedback imparted on the head of the golf club 24 when struck during a practice shot. Stronger or thicker materials may provide more resistance to the club head relative to thinner or weaker materials. Some materials may be designed to bend or flex upon impact. Other materials may be stiffer and resist such flexure. But, at no point should the intermediate section 52 prevent complete movement of the golf club 24 along its trajectory. The intermediate surface 52 should be capable of providing the type of resistance that a golfer may experience when creating the "preferred" divot during an iron shot. Of course, the type of resistance the golfer experiences may vary on the location where the golf ball lands on a real golf course and an interchangeable intermediate section 52 enables the golfer to customize the golf swing training aid 10 to the desired resistance.

The golf ball 22 is supported between one end of the upper surface 48 and the plane of the intermediate surface 52. Visually, the upper surface 48 represents the natural turf on a golf course, as explained above. The upper layer 68 of the upper surface 48 provides partial resistance as the golf club 24 is striking down and through the golf ball 22, simulating the resistance that is felt on a natural turf. This is some of the sensory feedback conveyed to the golfer in association with the golf swing training aid 10. The intermediate surface 52 additionally provides a visual target plane where the golfer should strike the golf ball 22. Specifically, the golfer should strike the intermediate surface 52 with the club head approximately perpendicular to the surface plane of the intermediate surface 52. This is important as the golfer is able to readily visually identify the position that the face of the golf club 24 should contact the golf ball 22. The upper surface 48 is positioned above the lower surface 50 preferably by a distance approximately equal to the depth of an "average" divot to enable the golfer to continue the downward movement of the golf club 24 along its trajectory.

Figure 7:
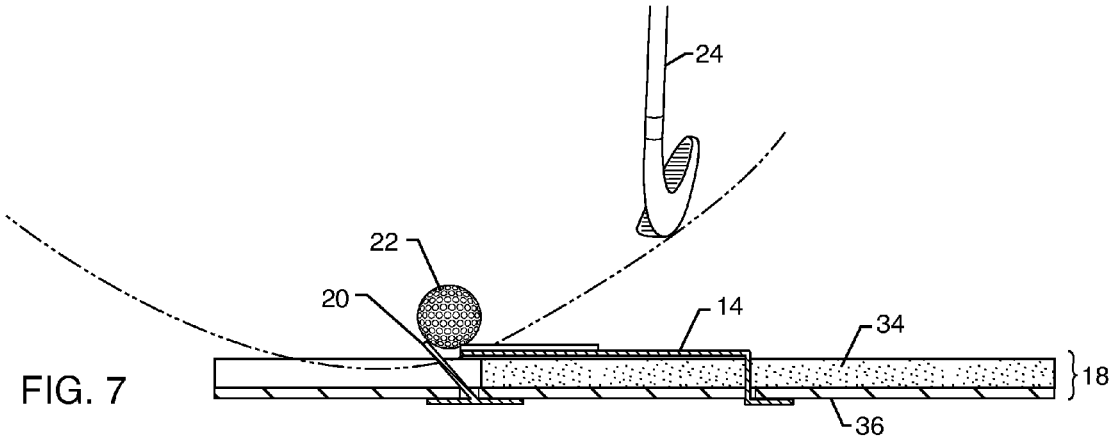
FIG. 7 is a sectional side view of the structure of FIG. 1, now with a golf ball about to be struck by a golf club.
Figure 8:
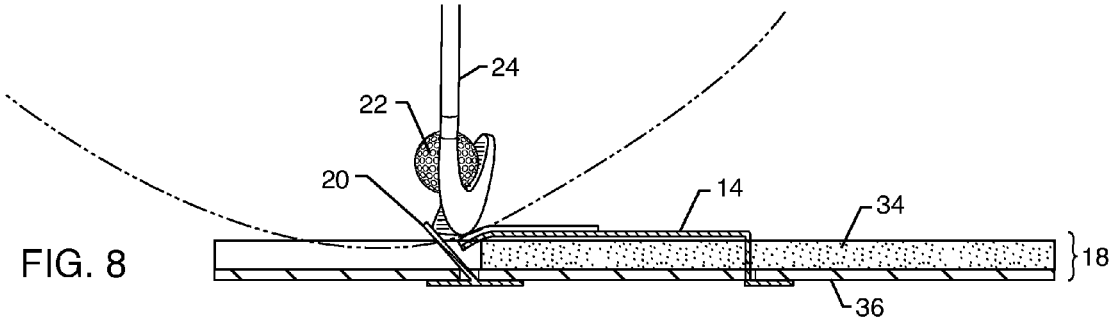
FIG. 8 is a sectional side view of the structure of FIG. 1, now with a golf club making contact with the golf ball.

The use of the embodiment of FIG. 11 is similar to the use depicted in FIGS. 7-10 of the other embodiment. The path of the golf club 24 along a trajectory is generally shown in successive positions starting in FIG. 7 and ending in FIG. 10. FIG. 7 illustrates the golf club 24 in an initial position along the trajectory. Here, the club head is traveling down toward the golf ball 22 on the downswing. Next, FIG. 8 illustrates the golf club 24 initiating contact with the golf ball 22. Specifically, the club head initiates contact with the edge of the upper surface 14 (48) and the golf club face initiates contact with the golf ball 22. In FIG. 8, the golf club face is aligned approximately perpendicular with the flexible ball support member 20 (intermediate surface 52). This enables the golfer to associate the position where the club head should drive down and contact the golf ball 22. The golf club 24 continues along the trajectory as the golfer strikes down through the golf ball 22 at this visually recommended angle. The golf club 24 experiences additional resistance as it passes by the upper surface 14 (48) and into the ball support member 20 (intermediate surface 52).

Figure 9:
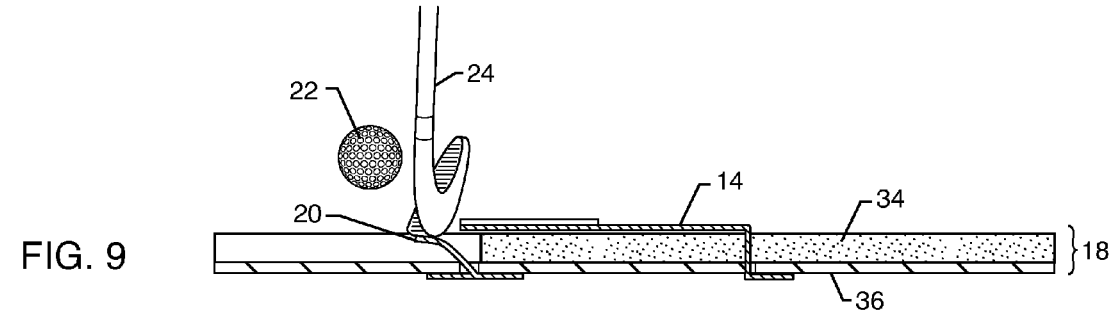
FIG. 9 is a sectional side view of the structure of FIG. 1, now just after a golf ball was struck by a golf club.

FIG. 9 more specifically illustrates the club head initiating contact with the ball support member 20 (intermediate surface 20) along the trajectory. Here, contacting the golf ball 22 with the angled face causes the golf ball 22 to lift into the air, up from a resting position between the upper surface 14 (48) and the ball support member 20 (intermediate surface 52), as is desired with many typical iron shots. The angled face provides the lift necessary to give the golf ball 22 the proper spin and height desired for maximum control and distance when hitting an iron shot. Subsequently, the golf club 24 continues along the trajectory and initiates direct contact with the ball support member 20 (intermediate surface 52). Accordingly, the ball support member 20 (intermediate surface 52) bends about the rubber base layer 36 (lower surface 50). The force necessary to bend or flex the ball support member 20 (intermediate surface 52) with the club head is imparted on the golf club 24 and is similar to a resistive force a golfer may experience when carving out a divot from a natural grass surface.

Figure 10:
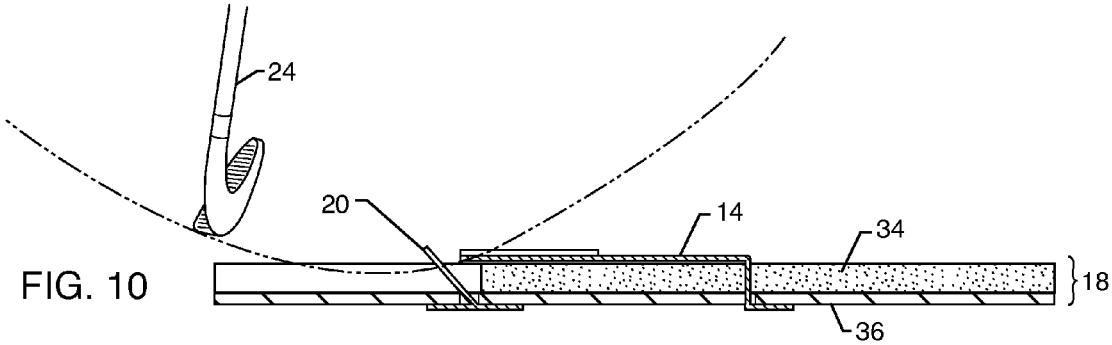
FIG. 10 is a sectional side view of the structure of FIG. 1, now with a golf club following through the swing after it made impact with a golf ball.

The rubber base layer 36 (lower surface 50) is the preferred bottom to the trajectory of the golf swing. Not only does the rubber base layer 36 (lower surface 50) prevent further physical movement of the golf club 24 downwardly, but it also provides a visual target plane that the golfer can aim to skim during the golf swing. The golfer preferably should only brush up against the rubber base layer 36 (lower surface 50) so as to ensure that the divot is not too deep. Thereafter, as shown in FIG. 10, the golf club 24 continues along the trajectory up and away from the rubber base layer 36 (lower surface 50) such that neither the head nor the face remain in contact with the rubber base layer 36 (lower surface 50).

The positioning of the rubber base layer 36 (lower surface 50) relative to the upper surface 14 (48), and in conjunction with the ball support member 20 (intermediate surface 52), avoids many of the potential injuries that a golfer may experience when practicing an iron shot with a flat hitting surface. Moreover, the depth of the rubber base layer 36 (lower surface 50) relative to the upper surface 16 (48) provides visual and physical reinforcement of the depth of the golf swing along the trajectory. In this regard, if the golf club 24 strikes the rubber base layer 36 (lower surface 50) too hard, or not all, the sensory feedback is relayed back to the golfer. A golfer may use the golf swing training aid 10 in the manner described above repetitiously and safely without damaging natural turf and without the risk of physical injury. Thus, the golf swing training aid 10 allows a golfer to repeatedly and safely practice developing the ability to consistently strike the golf ball 22 with an iron golf club at a preferred angle and trajectory. In turn, such a preferred golf swing will result in a proper divot.

Now referring back to the embodiments in FIGS. 1-10, the golf swing training aid 10 comprised a turf layer 34 adhered to a rubber base layer 36 with an upper surface 14 and a ball support member 20. Both the turf layer 34 and the rubber base layer 36 have slots 72 for the upper surface 14 and the ball support member 20 to fit within and thereby be captured in place from the weight of the mat 12. The upper surface 14 is a portion of a plastic part that can be generally described as being a Z-clip. The ball support member 20 is a portion of a plastic part that can be generally described as being a T-clip. As previously discussed, the Z-clip and T-clip are removable such that they may be changed out for different structures and embodiments. The rubber base layer is generally about a ½ of an inch thick, 12 inches wide, and 24 inches long. The U-shaped turf layer 34 is also generally about a ½ of an inch thick, 12 inches wide, and 24 inches long.

In yet another embodiment not shown in the figures, the rubber base layer 36 and the turf layer 34 can be molded as a single unit. For example, a dual durometer mat 10 can be comprised of molding the turf layer 34 from a rubber material which is molded in place and on top of the rubber base layer 36. The top layer would be molded of a softer rubber as compared to the harder rubber used for the rubber base layer 36. This embodiment would function similar to the embodiment of FIGS. 1-10, with the rubber base layer 36 and the turf layer 34 being combined into a single dual-durometer rubber construction. This embodiment would still have the slots 72 for allowing a Z-clip and T-clip to be installed forming the upper surface 14 and the ball support member 20.

In yet another embodiment, all the components parts can be manufactured together such that a single molded system remains incorporating all aspects of the golf swing training aid 10. For example, a dual-durometer mat 12 can be molded as described above and now where the upper surface 14 and the ball support member 20 are also simultaneously formed. The resulting product is a single part which incorporates an upper surface 14, a ball support member 20, an upper "turf" layer (rubber material) 34 and a rubber base layer 36. This single part construction can reduce manufacturing costs resulting in a cheaper product while still retaining all the functionality of this disclosure.

In summary, the golf swing training aid includes a flexible mat including an upper surface and a leading edge. The flexible mat has a defined thickness. A flexible ball support member is spaced from the leading edge for supporting a golf ball therebetween. A golf ball is temporarily supported between the leading edge and support member. The support member resiliently flexes away from the leading edge as the golf ball is struck by a golf club permitting the golf club to travel below the upper surface immediately beyond the leading edge and provide a divot feedback to a golfer.

The upper surface comprises resiliently flexible plastic and can also include a ball alignment feature. The ball alignment feature can be formed in a multitude of ways. In one embodiment the ball alignment feature includes a pair of protrusions on the upper surface thereby capturing the golf ball along a channel. In another embodiment the ball alignment feature is a scalloped cut along the leading edge thereby capturing the golf ball along the scalloped cut. In yet another embodiment the ball alignment feature is an open-ended slot disposed along the leading edge thereby capturing the golf ball along the slot.

The flexible mat includes an upper pad overlying a turf layer disposed below the upper surface. The flexible mat also can include a resiliently flexible/rubber-like base layer disposed below the turf layer. The turf layer may be Astroturf or any other suitable turf material. The flexible mat comprises a U-shaped recess and the ball support member can be disposed within the U-shape recess. The ball support member can also comprise a resiliently flexible plastic. In an embodiment, the ball support member is a cantilevered angled surface forming an obtuse angle relative to a top side of the upper surface. In an embodiment, the upper surface or the ball support member can be removably attached relative to the mat. This allows different structures to be utilized for providing different tactile feedback for different golfers.

Although several embodiments have been described in detail for purposes of illustration, various modifications may be made to each without departing from the scope and spirit of the invention. Accordingly, the invention is not to be limited, except as by the appended claims.

What is claimed is:

1. A golf swing training aid for simulating the feeling of creating a divot during a practice golf swing, comprising:

a flexible mat including an upper surface a leading edge, and an upper pad over overlying a turf layer, the flexible mat having a defined thickness; and a flexible ball support member spaced from the leading edge for temporarily supporting a golf ball adjacent to the leading edge;

wherein the support member resiliently flexes away from the leading edge as the golf ball adjacent to the leading edge is struck by a golf club permitting the golf club to travel below the upper surface of the flexible mat immediately beyond the leading edge and provide divot feedback to a golfer during the practice golf swing.

2. The aid of claim 1, wherein the upper surface comprises resiliently flexible plastic.

3. The aid of claim 2, wherein the upper surface comprises a ball alignment feature.

4. The aid of claim 3, wherein the ball alignment feature comprises an alignment channel, cut or slot.

5. The aid of claim 1, wherein the flexible mat comprises a resiliently flexible base layer disposed below the turf layer.

6. The aid of claim 1, wherein the flexible mat comprises a U-shaped recess, and wherein the ball support member is disposed within the recess.

7. A golf swing training aid for simulating the feeling of creating a divot during a practice golf swing, comprising:

a flexible mat including an upper surface and a leading edge, the flexible mat having a defined thickness; and a flexible ball support member spaced from the leading edge for temporarily supporting a golf ball adjacent to the leading edge, wherein the ball support member comprises a cantilevered angled surface forming an obtuse angle relative to the upper surface;

wherein the support member resiliently flexes away from the leading edge as the golf ball adjacent to the leading edge is struck by a golf club permitting the golf club to travel below the upper surface of the flexible mat immediately beyond the leading edge and provide divot feedback to a golfer during the practice golf swing.

8. The aid of claim 1, wherein the upper pad or the ball support member is removably attached relative to the mat.

9. A process for simulating the feeling of creating a divot during a golf swing, comprising:

providing a flexible mat having an upper surface, and a defined thickness, and an user ad overlying a turf layer;

temporarily supporting a golf ball adjacent to a leading edge of the upper surface and a ball support member spaced from the leading edge;

swinging a golf club through the golf ball wherein the ball support member resiliently flexes away from the leading edge as the golf ball is struck by a golf club;

permitting the golf club to travel below the upper surface of the flexible mat immediately beyond the leading edge; and providing divot feedback to a golfer during the golf swing.

10. The process of claim 9, wherein the upper surface comprises resiliently flexible plastic.

11. The process of claim 10, wherein the upper surface comprises a ball alignment feature.

12. The process of claim 11, wherein the ball alignment feature comprises an alignment channel, cut or slot.

13. The process of claim 9, wherein the flexible mat comprises a resiliently flexible base layer disposed below the turf layer.

14. The process of claim 9, wherein the flexible mat comprises a U-shaped recess, and wherein the ball support member is disposed within the recess.

15. The process of claim 9, wherein the upper pad or the ball support member is removably attached relative to the mat.

16. A process for simulating the feeling of creating a divot during a golf swing, comprising:

providing a flexible mat having an upper surface and a defined thickness;

temporarily supporting a gold ball adjacent to a leading edge of the upper surface and a ball support member spaced from the leading edge, wherein the ball support member comprises a cantilevered angled surface forming an obtuse angle relative to the upper surface;

swinging a golf club through the golf ball wherein the ball support member resilienty flexes away from the leading edge as the golf ball is struck by a golf club;

permitting the of club to travel below the upper surface of the flexible mat immediately beyond the leading edge; and providing divot feedback to a golfer during the golf swing.

* * * * *

UNITED STATES PATENT AND TRADEMARK OFFICE

CERTIFICATE OF CORRECTION

PATENT NO. : 8,157,667 B2
APPLICATION NO. : 12/883675
DATED : April 17, 2012
INVENTOR(S) : Robert Tome et al.

It is certified that error appears in the above-identified patent and that said Letters Patent is hereby corrected as shown below:

In column 11, line 44 (claim 1), insert a -- , -- after the word -- surface --.

In column 12, line 21 (claim 9), delete “and”.

In column 12, line 22 (claim 9), replace “user ad” with -- upper pad --.

In column 12, line 52 (claim 16), replace “gold” with -- golf --.

In column 12, line 60 (claim 16), replace “of club” with -- golf club --.

Signed and Sealed this
Twenty-ninth Day of May, 2012

David J. Kappos

David J. Kappos
*Director of the United States Patent and Trademark Office*